US005327152A

United States Patent [19]

Kruger et al.

[11] Patent Number: 5,327,152

[45] Date of Patent: Jul. 5, 1994

[54] SUPPORT APPARATUS FOR AN ACTIVE APERTURE RADAR ANTENNA

[75] Inventors: Bradford E. Kruger, Woodland Hills; Walter J. Noble, Valencia, both of Calif.

[73] Assignee: ITT Corporation, New York, N.Y.

[21] Appl. No.: 782,498

[22] Filed: Oct. 25, 1991

[51] Int. Cl.[5] ..... H01Q 21/00

[52] U.S. Cl. ..... 343/853; 361/707

[58] Field of Search ..... 342/368, 372; 343/853, 343/873, 893, 700 MS; 361/381-388, 393

[56] References Cited

U.S. PATENT DOCUMENTS

| | | | |
|---|---|---|---|
| 4,809,012 | 2/1989 | Tong | 343/853 |
| 4,823,136 | 4/1989 | Nathanson et al. | 343/853 |
| 4,851,856 | 7/1989 | Altoz | 343/720 |
| 4,891,651 | 1/1990 | Staehlin et al. | 343/853 |
| 4,987,425 | 1/1991 | Zahn et al. | 361/388 |
| 5,020,586 | 6/1991 | Mansingh | 361/384 |
| 5,030,961 | 7/1991 | Tsao | 343/700 MS |
| 5,083,132 | 1/1992 | Kanda et al. | 343/700 MS |
| 5,087,922 | 2/1992 | Tang et al. | 343/853 |
| 5,109,318 | 4/1992 | Fanari et al. | 361/388 |
| 5,132,648 | 7/1992 | Trinh et al. | 333/128 |

*Primary Examiner*—Donald Hajec
*Assistant Examiner*—Tan Ho
*Attorney, Agent, or Firm*—Arthur L. Plevy; Thomas L. Peterson

[57] ABSTRACT

An active aperture radar antenna includes a plurality of T/R modules and a plurality of radiators, each being supported upon an intermediate support structure disposed therebetween for holding the modules and the radiators at predetermined positions relative to one another. The support structure is a composite structure formed by ribbed support housings and joined by a central plate. The ribs in the support housings defining channels for accommodating coolant tubes and for stiffening the structure. The T/R modules contact the support structure proximate the transmit amplifier chains for enhanced cooling. The radiator array is formed upon a circuit board, is independent of the T/R modules and is disposed upon an opposing surface of the support structure. The T/R modules can be removed and replaced without disturbing any radiators or their relative coplanarity.

43 Claims, 6 Drawing Sheets

SUPPORT APPARATUS FOR AN ACTIVE APERTURE RADAR ANTENNA

FIELD OF THE INVENTION

The present invention relates to active aperture radar (AAR) antennas, and more particularly, to an AAR antenna configuration which provides more effective cooling of the included transmit/receive (TR) modules and a greater degree of modularity of antenna components permitting TR modules to be selectively replaced without disturbing the coplanarity of the radiator array.

DESCRIPTION OF THE PRIOR ART

The basic purpose, advantages, architecture, and operation of active aperture radar (AAR) systems has been known for many years. For example, the history of development, as well as, certain examples of modern AAR systems are discussed in the article entitled "Transmit/Receive Module Technology for X-Band Active Array Radar" by David N. McQuiddy, Jr., et al., Proceedings of the IEEE, vol. 79, No. 3, March 1991, pp. 308–341. In order to understand how the present invention represents an advancement over the prior art, such as that discussed in the aforementioned article, it should be appreciated that the antenna portion of state-of-the-art AAR systems includes two essential elements, viz., (1) a plurality of transmit/receive (T/R) modules and (2) a chassis or support structure for physically mounting the T/R modules and which also serves to distribute electrical power and control signals to the modules. The support structure also acts as a heat sink to cool the modules. Each T/R module has a transmit portion for producing high energy microwave output signals and a receiver portion for receiving reflected signals. The circuitry comprising the T/R modules is contained in an elongated housing which is adapted to plug into the support structure at one end and has integral radiating element projecting from the other end. The radiating elements may be dipole antenna elements through which the output signals created by the transmit portion of the T/R modules are transmitted to the environment and upon which the reflected signals from the environment impinge for transmission to the receive portion of the T/R modules. In known T/R modules, the transmitter portion employs an amplifier chain for producing the high-energy microwave output signals required. The amplifier chains are positioned in proximity to the integral radiator projecting from the free end of the module and are remote from the support structure. In operation, the amplifier chain converts significant portions of input power to the amplifier to heat, which, if not adequately dissipated, can adversely effect the module circuitry. It is difficult to remove heat from the amplifier chains of conventional T/R modules due to the position of the amplifiers relative to the support structure of the antenna. Namely, because the amplifiers are located at the free end of the module near the radiators and remote from the end of the module which contacts the support structure, the support structure can not function as an effective heat sink for cooling the amplifiers. Thus, even support structures having coolant lines and passages are ineffective in transferring heat from the amplifier chains. Accordingly, in modern AAR antennas special provisions for enhanced cooling are required. It has been recognized that tubes, having a length approximating that of the T/R modules and extending from the support structure in a direction parallel to the modules, permit the absorption of heat radiated from the amplifier chains at the free ends of the modules. That is, a plurality of cooling tubes, each having one end attached to the support structure and another end which is unsupported, are interspersed among the plurality of T/R modules so that heat radiated from the free ends of the modules is absorbed at the free ends of the tubes and conducted back to the support structure. The conduction of heat from the free ends of the cooling tubes to the support structure may be aided by coolant fluid circulated through the tubes. This configuration is inherently inefficient in that the relevant heat transfer occurs across an air gap, air being a poor conductor of heat. In addition, the tubes must be of modest size and of limited number in order to be dispersed throughout the array of T/R modules, these limitations having a corresponding limiting effect on cooling capacity. Besides being inherently inefficient, the cooling tubes are an expensive and complicated solution to the overheating problem of the transmitter amplifiers, requiring numerous parts and connections, all of which contribute to increased cost, size and weight. The size and weight factors are particularly important in one of the principle applications of AAR systems, viz., tactical, military aircraft.

Another limitation which is encountered in the construction and use of state-of-the-art AAR antennas, as described above, relates to the fact that the accuracy of the radar is dependent upon the coplanarity of the radiators. That is, the free ends of the radiators in the array should reside in the same plane. As can readily be appreciated, the degree of extension and the axial orientation of the radiators projecting from the T/R modules at the free end thereof is dependent upon the precision with which the module is made and affixed to the support structure. Small variations in the dimensions of the module and/or the supporting structure and/or the mounting of the module to the support, yield large variations of position of the radiator at the free end and disturb coplanarity. This also effects the degree of precision with which the ground plane can be fitted to the antenna. It is preferable to have a fixed radiator-to-ground plane clearance to provide proper radiator performance.

Since it is difficult to assemble an array of numerous modules with integral radiators so that the radiators have maximal coplanarity, the prospect of replacing a failed T/R module in the field represents the occasion for upsetting the coplanarity achieved. Due to this possibility, and to the overall difficulty of replacing individual failed modules, it is usually preferable to operate the antenna in a degraded mode, i.e., with inoperative modules, than to replace a small number of individual modules.

It is therefore an object of the present invention to provide an AAR antenna having a configuration that allows more effective cooling of the T/R modules and, in particular, the transmit amplifiers.

It is a further object to provide an antenna configuration having a more stable mounting for the radiators of the antenna and a greater degree of modularity of antenna components which permits removing and replacing defective TR modules without disturbing the coplanarity of the radiator array.

SUMMARY OF THE INVENTION

The disadvantages of conventional AAR antennas are overcome by the present invention which includes a plurality of T/R modules and a plurality of radiators, each being supported upon an intermediate support structure disposed therebetween for holding the modules and the radiators at predetermined positions relative to one another.

BRIEF DESCRIPTION OF THE DRAWINGS

Other objects, features and advantages of the present invention will be apparent from the following detailed description of the preferred embodiments with reference to the drawings, of which.

DETAILED DESCRIPTION OF THE INVENTION

Figure 1:
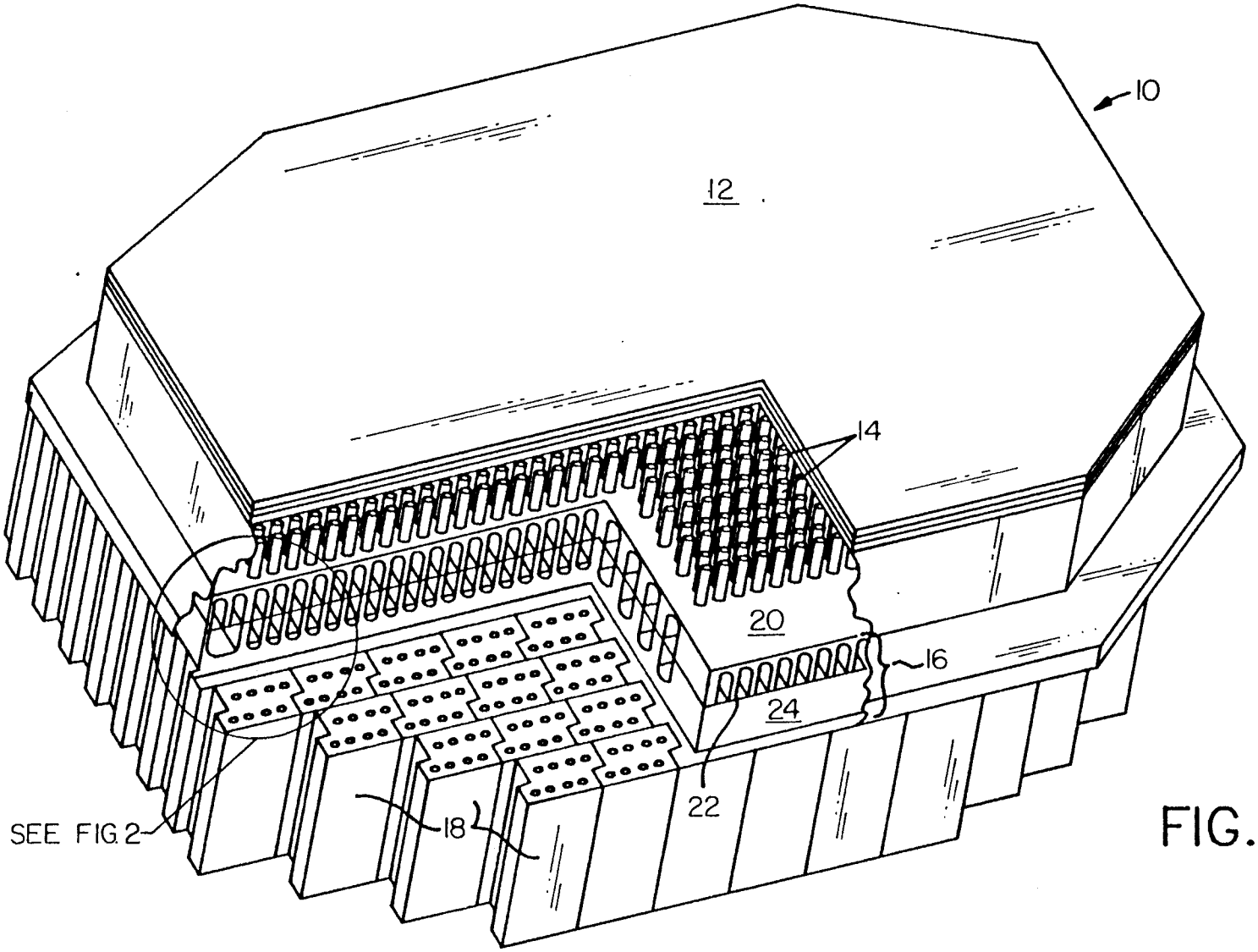
FIG. 1 is a partially cross-sectional, perspective view of an active aperture radar antenna in accordance with an exemplary embodiment of the present invention.

Referring to FIG. 1, an active aperture radar (AAR) antenna 10 in accordance with the present invention includes a radar-transparent cover or radome 12 for shielding the internal antenna components from contaminants in the environment. Beneath the radome 12, a plurality of radiators 14 are disposed in a regular array upon one side of a support structure 16. A plurality of transmit/receive (T/R) modules 18 are attached to the other side of the support structure 16 opposite the radiators 14. The radiators 14 are electrically connected by conductors passing through the support structure 16 and, as in conventional antennas of this type, the T/R modules can operate to generate or transmit and receive microwave signals to and from the environment via the radiators or antenna elements 14. Unlike conventional antennas, however, the support structure 16 is disposed between the radiators 14 and the T/R modules 18 and therefore is more effective in providing the dual function of support and cooling, by, inter alia, allowing coolant lines to be positioned in proximity to the heat generating transmit amplifiers of the T/R modules 18, as will be explained further below.

Due to the intermediate position of the support structure 16, the array of radiators 14 and the modules 18 may be independently and removably affixed thereto and thus exhibit improved location certainty over the prior art. That is, the modules 18 can be removed or replaced without effecting the radiators 14. In the exemplary embodiment depicted, the support structure 16 is a composite assembly, being formed from a pair of ribbed members of housing sections 20 and 24 separated by a planar shear plate 22. The housings as 20 and 24 can be fabricated from metal stock with the channels formed to provide upstanding ribs or may be separately formed by plates with ribs formed thereon. The construction of such housing sections as 20 and 24 is well known. This particular configuration meets certain objectives pertaining to ease of assembly, rigidity, lightness and availability of materials, but it is not intended that the invention be limited to this specific construction. It should be appreciated that the support structure 16 could be monolithically constructed, have coolant passages therein which are formed by drilling, etc., or formed from a pair of ribbed members or from a single ribbed housing section bonded to a flat plate, each of these expedients being within the realm of the normally skilled artisan, given the teaching of the present invention. The housing sections 20 and 24 and the planar member 22 are each preferably fabricated from aluminum because of its high stiffness-to-weight ratio and relatively low cost, although other suitable materials can be employed to make the support structure 16.

Figure 2:
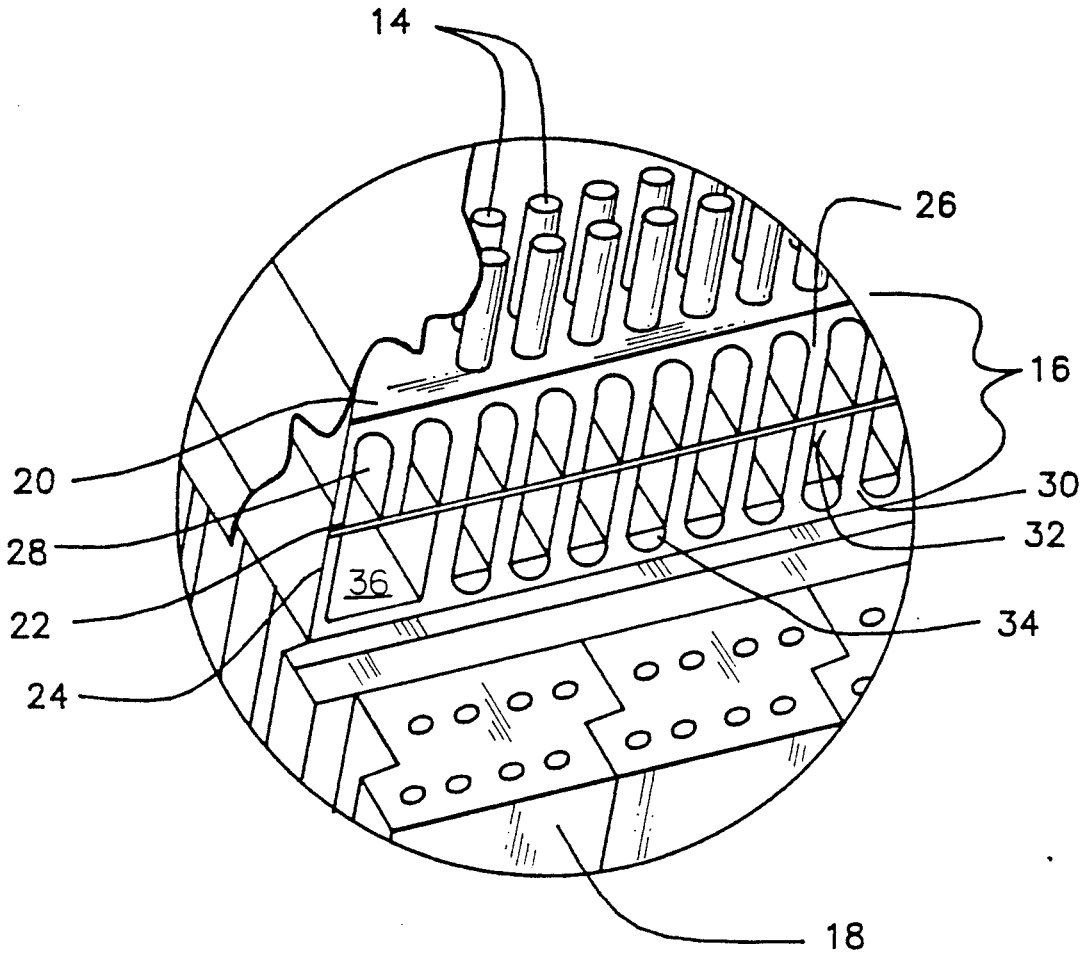
FIG. 2 is an enlarged view of the fragment encircled and labelled with roman numeral II in FIG. 1.

Referring now to FIG. 2, the ribbed housing section 20 is shown supporting an array of radiators 14. Each radiator 14 has one end connected to a side of the housing section 20 by welding, soldering or other similar methods. An upper, free end of each radiator 14 extends away from the support structure 16 toward the radome 12. As is known in the art, it is desirable that the upper ends of the radiators 14 be substantially co-planar to ensure the accuracy of the radar and to control the side-lobe transmissions. As previously noted, this coplanar condition is more difficult to achieve utilizing known T/R modules with integral radiator elements. In the present invention, however, the radiator array is assembled upon a single rigid substrate, viz., the support structure 16, and more specifically, in the embodiment shown in FIG. 2, upon the upper surface of the ribbed housing 20. This configuration simplifies the construction of the array, assures coplanarity, and truly fixed radiator spacing. The radiator elements 14 depicted are representative only—many different types of radiators could be used. The only requirement is that whichever is selected, all radiators 14 are the same. The support structure 16 can be fabricated to support any selected radiators 14. As an alternative to mounting the radiators 14 directly to the support structure 16, the array of radiators 14 can also be mounted on a circuit board which is then affixed to the upper surface of the ribbed housing section 20, as shall be further described in reference to FIG. 6.

The side of the housing section 20 distal to the radiators 14 has a plurality of ribs 26 extending along the length thereof which define a plurality of corresponding troughs or channels 28 extending over the surface of the housing section 20. The ribbed construction reduces the weight of the plate 20 while preserving structural strength. The planar shear plate 22 positioned between the ribbed housing sections 20 and 24 functions as a bonding surface therefore. The ribs 26 of the housing section 20 can be connected to a surface of the plate 22 by structural epoxy or other equivalent bonding materials. The ribbed housing section 24 has essentially the same form as that of housing 20, but is adapted to receive and retain on an exterior surface thereof a plurality of T/R modules 18. A plurality of ribs 30 extending along its interior surface defines a plurality of troughs or channels 32. The ribs 30 are bonded to the shear plate in a similar fashion as ribs 26. A coolant tube 34 is positioned in each of the channels 32. The coolant tubes 34 are fabricated from a heat conducting material, such as copper, or copper plated with a material to prevent corrosion between the copper tubing and the aluminum support structure 16. A liquid coolant, such as, water or ethylene glycol, or a mixture of water and ethylene glycol, is circulated through the tubes 34. Of course, the present invention contemplates that any coolant liquid or gas could be employed. A means for cooling the coolant, such as a compressor driven refrigeration system may be coupled to the matrix of coolant tubes 34 to maintain the liquid coolant at a predetermined temperature, as is known in the art. The support structure 16 can also be zoned so that the liquid coolant can be maintained at a uniform temperature throughout the tubes. The outer surfaces of the two ribbed housing sections 20 and 24 are, in the embodiment shown, substantially parallel and flat. This particular parallel relationship between housing sections 20 and 24 is not required, but it is preferable, in that it is the configuration which provides a constant distance between the T/R modules 18 and radiators 14.

Figure 3:
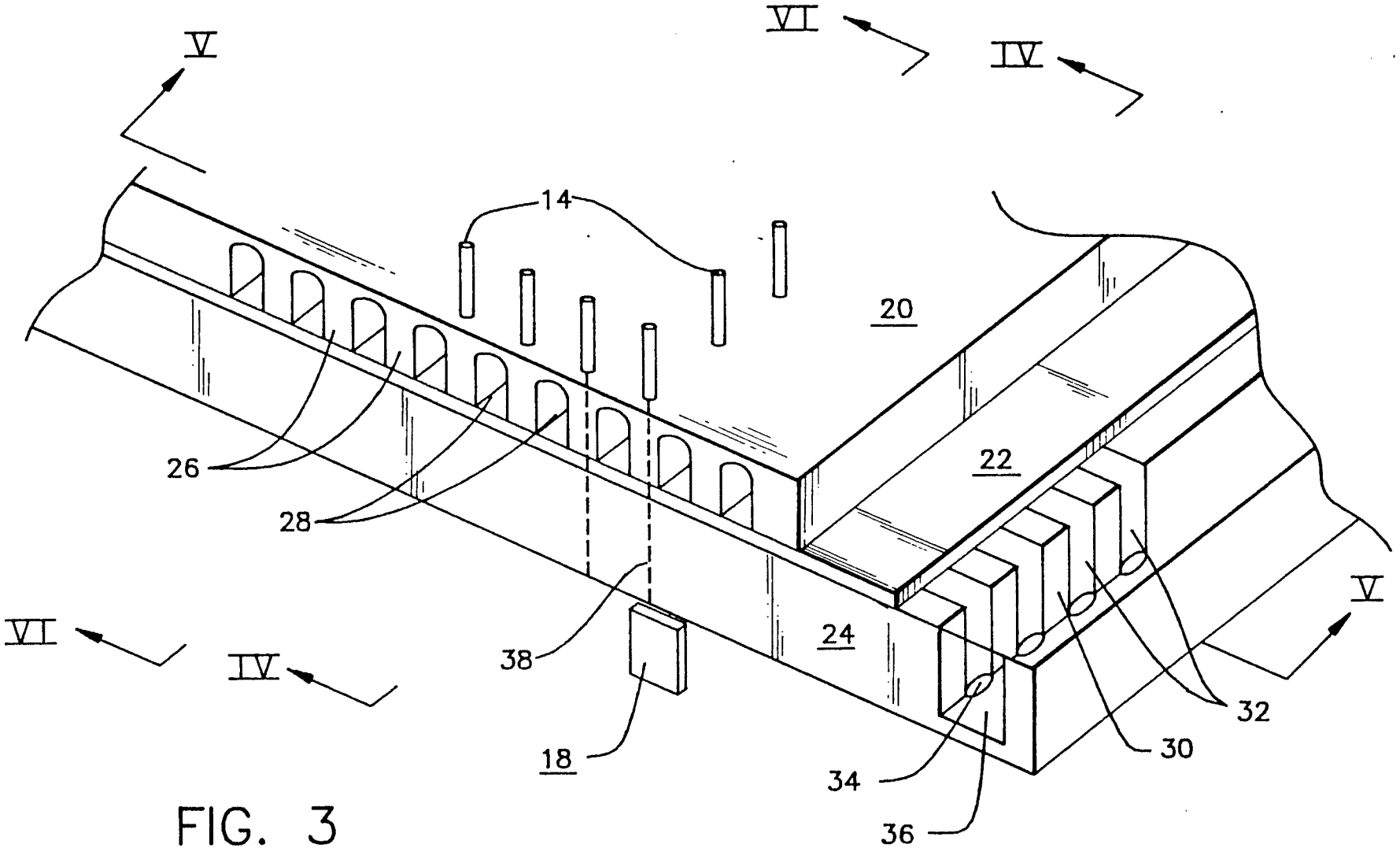
FIG. 3 is an enlarged perspective view of a fragment of an alternative embodiment of the support structure of the invention shown in FIG. 1.

FIG. 3 shows an alternative construct for the support structure 16 wherein the ribs 26 and 30 of the first and second plates 20 and 24, respectively, are oriented transverse relative to one another. An angle of relative displacement of approximately ninety degrees is depicted, however, any angular displacement greater than approximately 30 degrees could be employed. In this manner, the ribs 26 and 30 overlap at a number of intersections when viewed, e.g., along a line perpendicular to the outer surface of the ribbed housing section 20 upon which the radiators are affixed. This angular displacement (greater than 30 degrees) of the ribs on the respective plates results in the support structure 16 having improved torsional rigidity along its major axes. The intersecting areas also serve as a convenient location for a conduit through which a signal line, such as a coaxial cable 38, may pass through the support structure 16 coupling each radiator 14 to its corresponding T/R module 18, as further illustrated in FIGS. 4 and 5. It should be noted that FIG. 3 is appropriate only for orthogonal radiator 14 spacing. FIG. 2 is the more general case, i.e., the rib angle is greater than 30 degrees, but less than 90 degrees.

Figure 4:
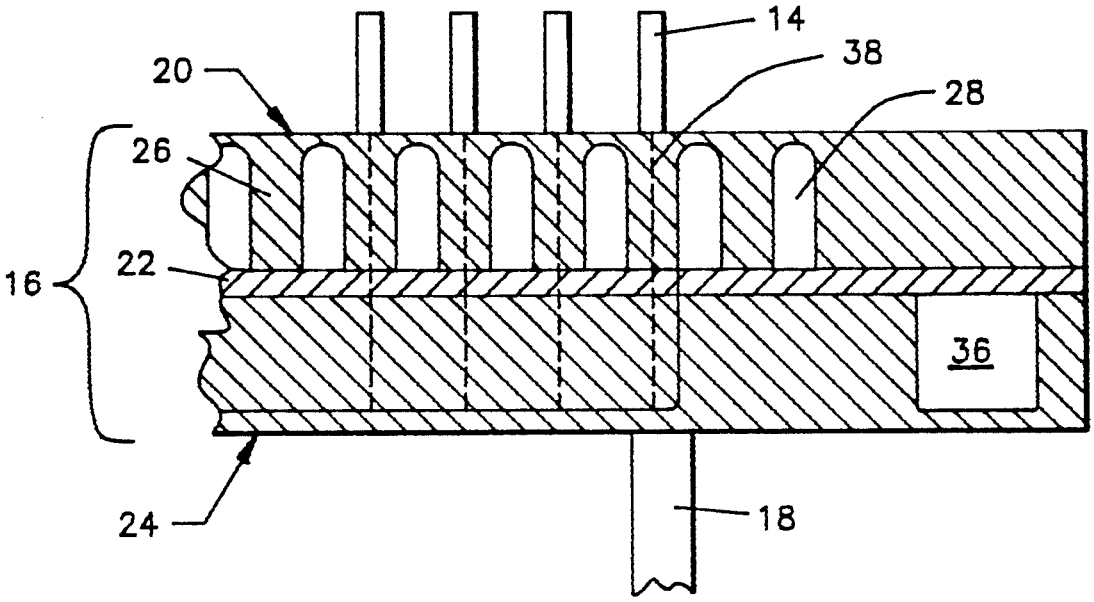
FIG. 4 is a cross-sectional view of the support structure depicted in FIG. 3 taken along section line IV—IV and looking in the direction of the arrows.

In FIG. 4, the path of traversal of an electrical connector for connecting a T/R module 18 to an associated radiator 14 is figuratively depicted with dashed line 38, which may represent, for example, a coaxial cable.

Figure 5:
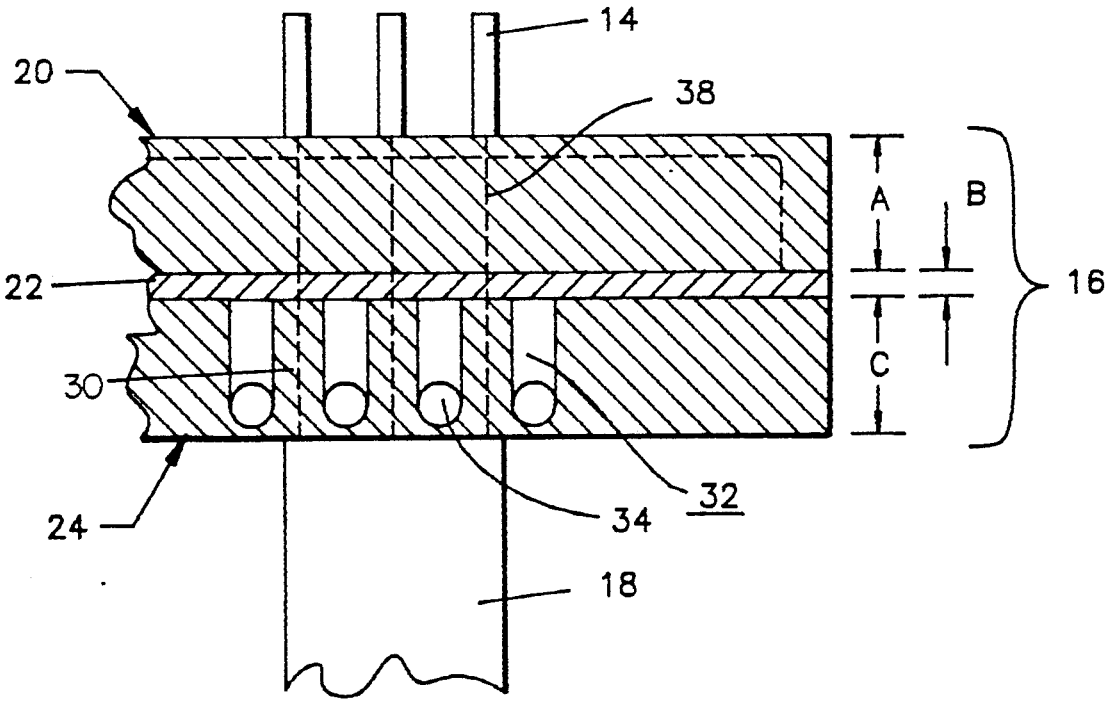
FIG. 5 is a cross-sectional view of the support structure depicted in FIG. 3 taken along section line V—V and looking in the direction of the arrows.

FIG. 5 shows the vital feature of the present invention, viz., the position of coolant tubes 34 relative to the T/R module 18. As previously mentioned, known T/R modules have their transmit amplifiers located at the end closest to an associated integral radiator element. In the present invention, the amplifiers can remain in this position, viz., the most proximate element with respect to the radiators 14, however, due to the interstitial support structure 16, coolant tubes 34 can be positioned in close proximity to the amplifiers so that there is no difficulty in conducting excess heat away from the amplifiers. By way of example, the ribbed sections 20 and 24 may be approximately 1 inch thick, with the shear plate 22 having a thickness of about 1/16 to ⅛ of an inch. The coolant tubes 34, in a support structure 16 having these dimensions, would then be spaced about 1/16 to ⅛ inch away from the abutting face of the T/R modules 18. It is understood, however, that the various components of the support structure can be constructed within a broad range of dimensions depending on the particular radar application.

Figure 6:
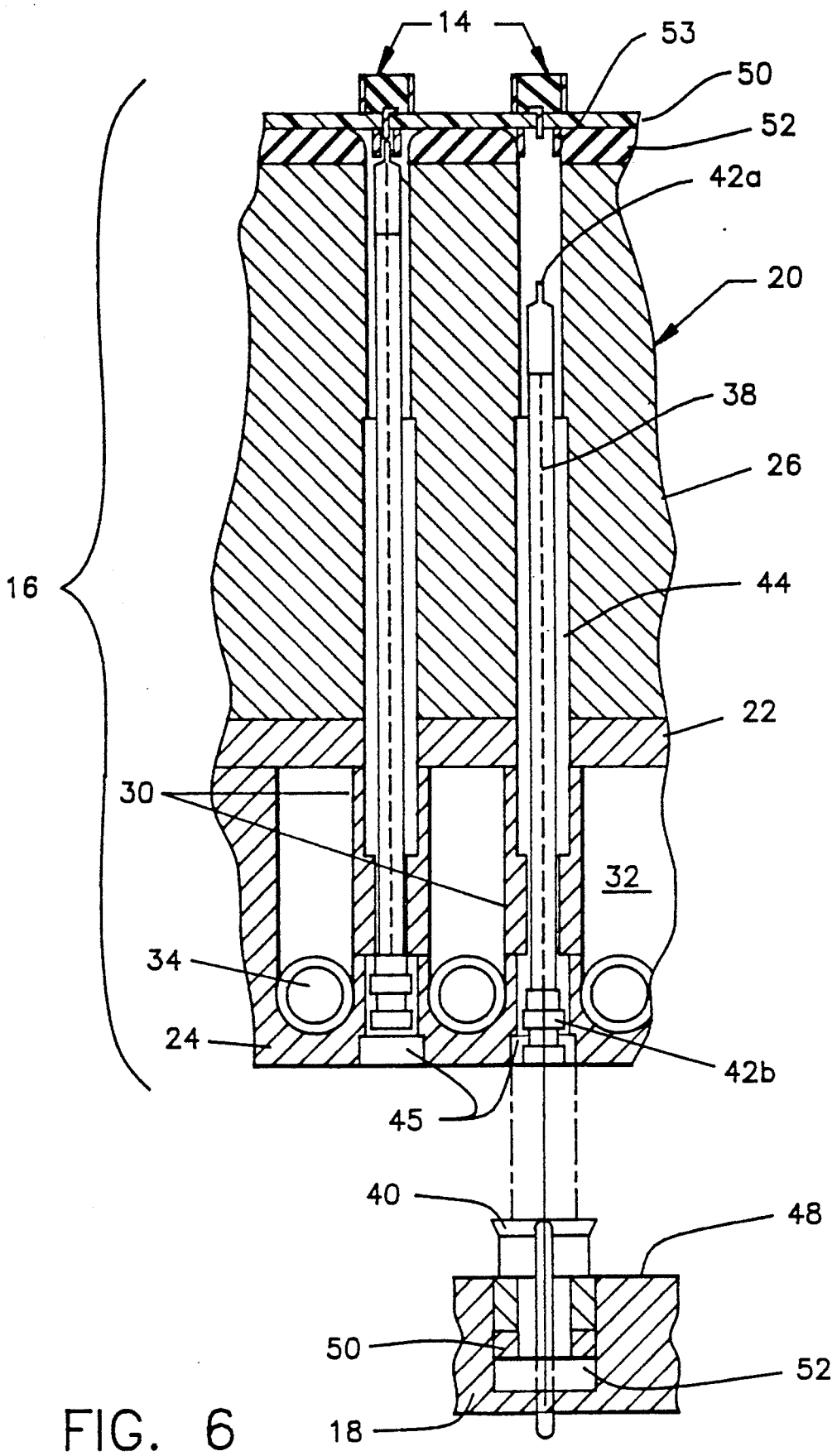
FIG. 6 is a cross-sectional view of the support structure depicted in FIG. 3 taken along section line VI—VI, looking in the direction of the arrows and showing an embodiment of the present invention wherein the radiator elements are disposed on a circuit board.

FIG. 6 shows how each radiator 14 may be coupled to a corresponding T/R module 18 by a coaxial cable 38. A passageway 44 extends from the outer surface of plate 20, through the ribs 26 and 30 at their intersection and through the intermediate plate 22, to the outer surface of section 24. The passageway 44 may be sized and shaped to permit the cable 38 to be slid therefrom in one direction to facilitate connection, e.g., to the T/R modules 18. The cable 38 is provided with suitable standard quick disconnect fittings, e.g., plugs and/or sockets **42*a* and 42*b*. Similarly, the T/R module 18 is equipped with a mating connector fitting 40 which, in the embodiment shown, projects above the upper surface 48 of the module. In this instance, section 24 must be provided with recesses 45 to accommodate the projecting module connector 40. To connect a module, the cable 38 is extended from the passageway 44 and the plug 42*b* joined with connector 40. The connector 40 is then inserted into the recess 45 and the module 18 pressed against the surface of section 24 where it is retained by, e.g., screws. The plug 42*a* at the other end of the cable 38 is simultaneously pushed home into the radiator 14 making the connection. It should be understood that a number of alternatives could be employed in lieu of the cables 38 described. For example, wires with end connectors could be rigidly affixed within the passageway 44** in a matrix of hardened polymer.

As shown in FIG. 6, the array of radiators 14 can be fabricated on a PC board 50 as a convenient method for creating a coplanar array and to facilitate mounting the array to the support structure 16. In this instance, the electrical connectors, e.g., the plugs **42*a*, plug into sockets 53 disposed on the circuit board opposite an associated radiator 14 and electrically connected thereto. A dielectric of air or closed cell foam 52 is positioned between the circuit board and the front surface of the plate 20**.

Figure 7:
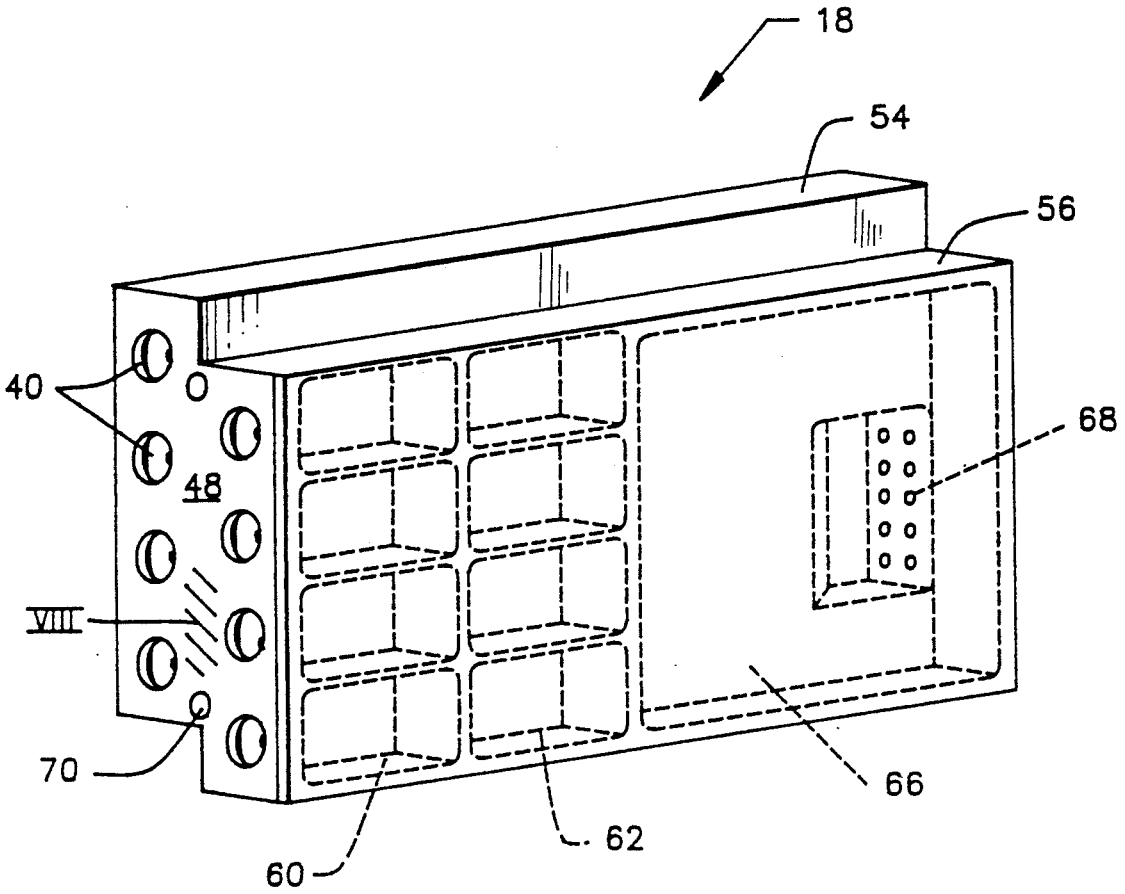
FIG. 7 is a perspective, partially phantom view of a T/R module with internal components figuratively depicted in dashed lines.
Figure 8:
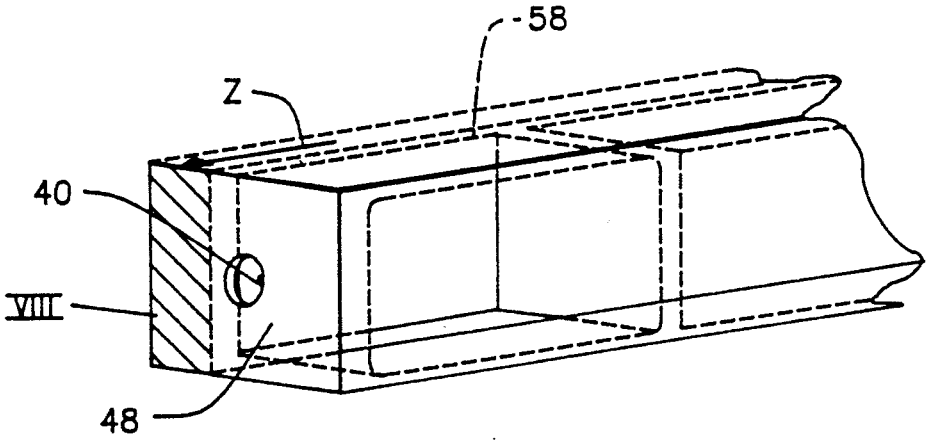
FIG. 8 is a perspective view of an enlarged fragment of the T/R module shown in FIG. 7 proximate cross-hatched area labelled VIII.

FIGS. 7 and 8 show certain aspects of the internal configuration and placement of circuit components within the T/R module 18. The figures are related, in that, cross-hatched area VIII in FIG. 7 corresponds to cross-hatched area VIII in FIG. 8, FIG. 8 being an enlarged view of a fragment of the module 18 proximate the cross-hatched area. Each of the T/R modules 18 consists of two sections 54 and 56 joined along a common center spine 58 (see FIG. 8). The spine 58 is preferably fabricated from aluminum or other suitable heat conductive material. In general, it is preferred that all module components, and especially the heat generating components, be mounted in close association with the central heat conductive spine. 58 to promote the conduction of heat to the spine 58. The heat then flows toward the support structure 16 as indicated by arrow "Z" in FIG. 8. Each of the sections 54 and 56 typically contains from one to four transmit/receive units, each having discrete transmitter 60 and receiver 62 subunits. The transmitter subunits 60, depicted figuratively in dashed lines, are accommodated within the module housing close to the front surface 48 of the module 18 and include the heat generating amplifier chains discussed above. The receiver subunits 62 are located behind the transmitter subunits 60 within the module 18. Both the transmitters and receivers in state-of-the art modules are Gallium Arsenide (GaAs) monolithic microwave integrated circuits (MMICs). Common circuitry 66, shared by more than one transmit/receive unit, is located at the rear of the module 18 proximate a connector 68 through which the control, R/F signals and power are introduced. Apertures 70 receive a mechanical fastener such as a screw (not shown) to releasably secure the T/R module 18 to the ribbed plate 24. FIGS. 7 and 8, illustrate an alternative configuration for the module connectors 40, which do not extend above the surface 48, like those depicted in FIG. 6.

The objectives of the invention are realized in that the invention shown and described herein provides an AAR antenna having a configuration that allows more effective cooling of the T/R modules 18 and, in particular, the transmit amplifiers. This is due to the placement of the support structure 16 between the T/R modules 18 and the array of radiators 14. The ribbed support structure 16 described accommodates coolant lines 34 which may be located in proximity to the transmit amplifiers of the T/R modules 18.

Further, the present invention provides an antenna configuration having a more stable mounting for the radiators 14 upon a common monolithic member, either the surface of the plate 20 or the circuit board 50, insuring coplanarity, fixed radiator spacing, and facilitating fabrication. The intermediate support 16 also increases the degree of modularity of antenna components in that it permits the removal and replacement of defective TR modules 18 without disturbing the radiator 14 array.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

We claim:

1. An active aperture radar antenna, comprising:

a plurality of T/R modules for producing and processing microwave signals;

a plurality of radiating elements, electrically coupled to said modules, for transmitting said microwave signals toward a target object and receiving signals reflected from said target object; and support means for supporting said modules and said radiating elements in predetermined relative positions, said support means defining an interior flow passage between said modules and radiating elements and a surface exterior to said flow passage for supporting said modules, wherein said support means surface is actively cooled by the flow of coolant through said flow passage, thereby providing an actively cooled heat sink to said modules.

2. The apparatus of claim 1, wherein said T/R modules project from said support means in one direction and said radiating elements project from said support means in another direction.

3. The apparatus of claim 2, wherein said one direction and said another direction are substantially opposite.

4. The apparatus of claim 1, where said T/R modules are coupled to said support means in thermally conductive manner, thereby enabling heat generated by said T/R modules to be dissipated by said support means.

5. The apparatus of claim 1, wherein each of said plurality of T/R modules is coupled to said support means in a selectively removable manner, whereby each of said plurality of modules can be independently attached to, or removed from, said support means.

6. The apparatus of claim 5, wherein each of said plurality of T/R modules is electrically interconnected to said radiating elements as each of said plurality of modules is selectively coupled to said support means.

7. The apparatus of claim 1, wherein said radiating elements are disposed on at least one circuit board positioned on an outer surface of said support means.

8. The apparatus of claim 1, further comprising connecting means, disposed within said support means, for selectively electrically connecting said T/R modules and said radiating elements.

9. The apparatus of claim 8, wherein said connecting means includes coaxial cables.

10. The apparatus of claim 9, wherein said modules are held to said support means by bolts passing through said modules and into mating threaded apertures in said support means.

11. The apparatus of claim 8, wherein said connecting means includes a conductive element that is electrically insulated from said support means and passes through said support means electrically connecting at least one of said plurality of radiators to each of said T/R modules.

12. The apparatus of claim 11, wherein each of said plurality of radiating elements project from said support means such that an end of said radiating elements distal to said support means resides proximate a single plane.

13. The apparatus of claim 12, further including means for controlling said T/R modules, means for cooling said coolant and means for circulating said coolant through said passages.

14. The apparatus of claim 12 wherein said radiating elements are disposed on at least one circuit board held in a position proximate a surface of said support means.

15. The apparatus of claim 14, further including a dielectric layer disposed between said circuit board and said support means.

16. The apparatus of claim 15, wherein said dielectric layer is closed cell foam and wherein said means for connecting is a plurality of coaxial cables passing through said support means electrically insulated therefrom and connecting each of said plurality of T/R modules to a selected set of at least one of said radiating elements.

17. The apparatus of claim 12, wherein said support means is a composite housing including at least two housing section members.

18. The apparatus of claim 17, wherein a first of said at least two members has a plurality of raised areas distributed over a surface thereof, said raised areas contacting another of said at least two members when conjoined in said composite housing.

19. The apparatus of claim 18, wherein said raised areas are elongated parallel ribs.

20. The apparatus of claim 19, wherein said parallel ribs define channels therebetween, and further including cooling tubes disposed within said channels for receiving the flow of coolant.

21. The apparatus of claim 20, wherein said cooling tubes are positioned in proximity to said T/R modules held by said support means.

22. The apparatus of claim 21, wherein said cooling tubes are copper.

23. The apparatus of claim 22, wherein said tubes are plated with a material that is galvanically compatible with the support structure.

24. The apparatus of claim 19, wherein a second of said at least two members has a plurality of raised parallel ribs distributed over a surface thereof, said ribs of said first and second members facing towards one another.

25. The apparatus of claim 24, wherein said at least two housing section members are three in number and include an intermediate plate disposed between said first and second members.

26. The apparatus of claim 25, wherein said ribs of said first and second members extend in the same general direction.

27. The apparatus of claim 26, wherein said ribs of said first and second members are substantially aligned with one another.

28. The apparatus of claim 25, wherein said ribs of said first member extend at an angle relative to said ribs of said second member, said ribs of said first and second members intersecting at a plurality of locations when viewed along a line perpendicular thereto.

29. The apparatus of claim 28, wherein said angle is approximately 30 to 90 degrees.

30. The apparatus of claim 29, wherein said connecting means is a plurality of individual connectors passing through said support means at a selected set of said plurality of intersecting locations.

31. A radar antenna, comprising:

a plurality of radiating elements for transmitting microwave signals;

heat sink means coupled to said radiating elements; and a plurality of modules for producing said microwave signals, said plurality of modules being removably attachable to said heat sink means wherein said modules are both cooled by said heat sink means and electrically coupled to said radiating elements when said plurality of modules are selectively attached to said heat sink means.

32. The apparatus of claim 31, wherein said heat sink means is actively cooled by the flow of coolant therethrough.

33. An active aperture radar antenna comprising:

a plurality of T/R modules for producing and processing microwave signals;

a plurality of radiating elements electrically coupled to said modules, for transmitting said microwave signals toward a target object and receiving signals reflected from said target object; and support means for supporting said modules and said radiating elements in predetermined relative positions, said support means including a first external surface in supporting contact with said radiating elements and a second external surface in supporting contact with said modules, and said support means defining at least one flow passage disposed between said external surfaces, wherein said support means is actively cooled by the flow of coolant through said flow passage.

34. The apparatus of claim 33, wherein said radiating elements project from said first external surface in one direction and said modules project from said second external surface in another direction.

35. The apparatus of claim 33, further comprising connecting means for selectively electrically connecting said T/R modules and said radiating elements.

36. The apparatus of claim 35, wherein said connecting means passes through said support means.

37. The apparatus of claim 33, wherein each of said plurality of radiating elements projects from said first external surface that an end of said radiating elements distal to said support means resides proximate a single plane.

38. The apparatus of claim 33, wherein said support means is a composite housing including at least two housing section members.

39. The apparatus of claim 38, wherein said at least two housing section members are three in number and include an intermediate plate disposed between first and second members.

40. The apparatus of claim 39, wherein said first member defines said first external surface and said second member defines said second external surface.

41. The apparatus of claim 38, wherein a first of said at least two members has a plurality of parallel raised areas distributed over a surface thereof, said raised areas contacting another of said at least two members when conjoined in said composite housing, thereby defining a plurality of parallel channels.

42. The apparatus of claim 41, further including a plurality of tubular members comprised of a heat conductive material, each respective tubular member being disposed in a corresponding one of said channels and accommodating the flow of coolant therethrough.

43. The apparatus of claim 41, wherein a second of said at least two members of said at least two members has a plurality of parallel raised areas distributed over a surface thereof, the raised areas of said first and second members facing each other.

* * * * *